US005219241A

United States Patent [19]

Picton

[11] Patent Number: 5,219,241

[45] Date of Patent: Jun. 15, 1993

[54] CRASH BARRIER POST

[76] Inventor: Valentine L. Picton, 156 Seaspray Way, Port Hueneme, Calif. 93041

[21] Appl. No.: 890,524

[22] Filed: May 29, 1992

[30] Foreign Application Priority Data

Jun. 4, 1991 [NZ] New Zealand ..... 238396

[51] Int. Cl.[5] ..... E01F 15/00

[52] U.S. Cl. ..... 404/6

[58] Field of Search ..... 404/6-9

[56] References Cited

U.S. PATENT DOCUMENTS 5,069,576 12/1991 Pomero ..... 404/6

*Primary Examiner*—Thuy M. Bui

[57] ABSTRACT

A post for supporting a crash barrier rail is disclosed. The post is a one piece plastics moulding comprising a leg from the upper end of which projects a shoulder having an outer face which is shaped to conform to the inner face of the rail. The post has a flat upper face for driving the post into the ground. A nut is moulded into the post and a passage extends between the outer face of the shoulder and the nut for receiving a bolt by means of which the rail is fixed on the post. A transverse passage may be moulded into the shoulder to provide a ligament joining the lower part of the outerface of the shoulder to the leg. This ligament will yield preferentially when the rail undergoes impact, providing increased elasticity to the barrier. The leg may be provided with a peripheral recess at which the leg will shear preferentially. The post may be moulded of recycled plastics.

8 Claims, 2 Drawing Sheets

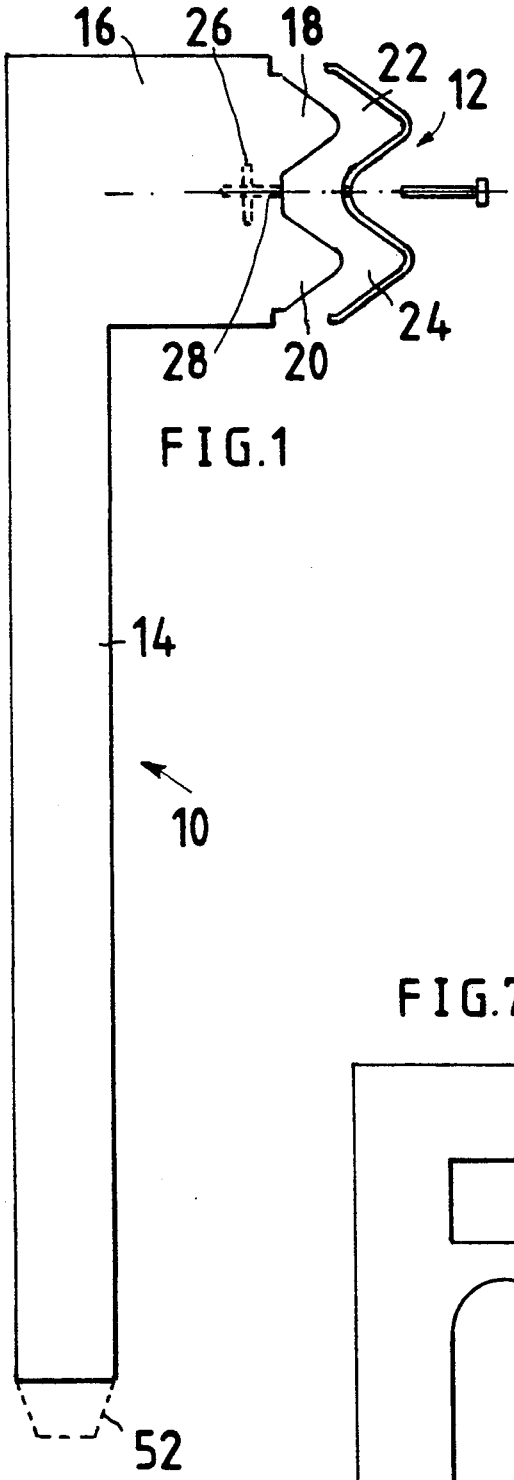
FIG.1
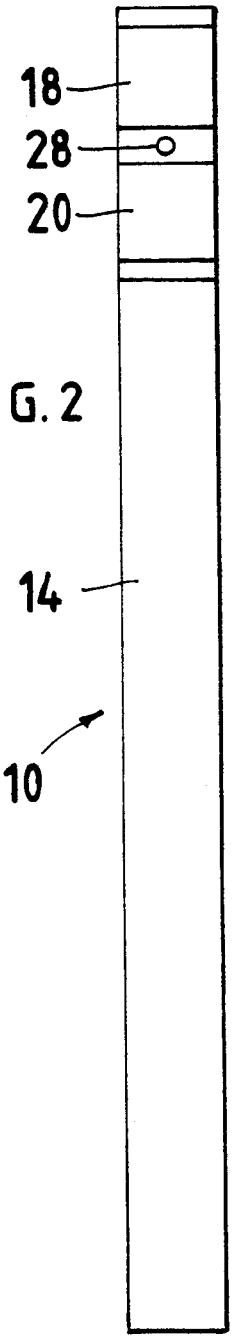
FIG.2
FIG.7
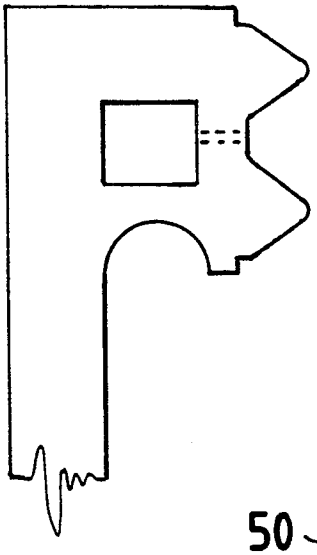
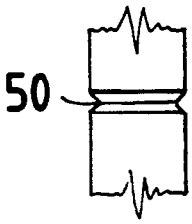
FIG.8

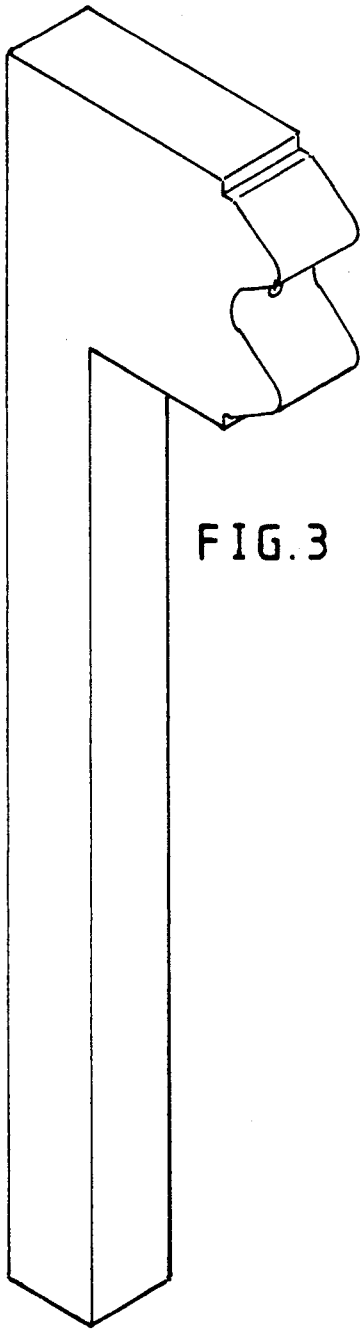
FIG. 3
FIG. 4
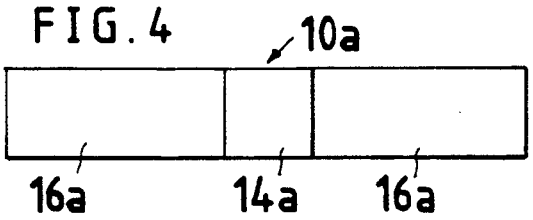
FIG. 5
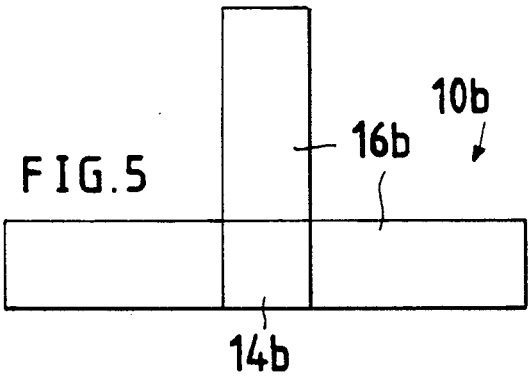
FIG. 6
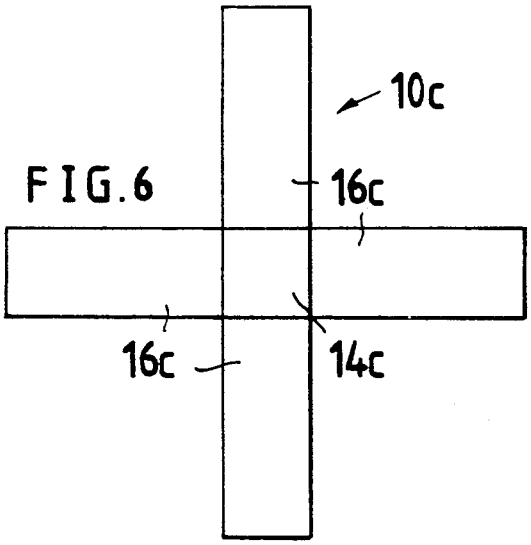

CRASH BARRIER POST

FIELD OF THE INVENTION

This invention relates to crash barrier posts.

BACKGROUND OF THE INVENTION

The development of modern motorways has accentuated the need for a barrier between lanes of traffic travelling in opposing directions along roads. Such barriers help to prevent a vehicle which goes out of control when proceeding in one direction from crossing into the path of a vehicle proceeding in the opposite direction.

DESCRIPTION OF THE PRIOR ART

Various types of crash barriers have been developed. One such type comprises horizontally disposed rails mounted on spaced apart posts let into the ground. The rails are commonly of steel, pressed so that in cross section they have the shape of a W.

It has been found by experience that the posts for supporting the rails require careful design. They need to be strong enough so that they do not break too easily when the rail is struck by a vehicle; however the design and construction of a post should also be such that, if it is struck by a vehicle, injury to the occupants of the vehicle and damage to the vehicle itself is minimised. For this reason such materials as steel and concrete are not favoured for fabricating the posts. Crash barrier posts should also be capable of withstanding the elements for many years with minimal attention without deterioration.

Up to the present time it is believed that most crash barrier posts have been constructed of wood. Wood is economical for this purpose and is easily worked. Moreover it is strong enough to support the rails and at the same time it will break under heavy impact so as to reduce the risk of injury to persons and damage to vehicles.

Wood is not however without its disadvantages. It is relatively brittle and it is inclined to rot in wet conditions. An important disadvantage of wood arises from what is considered the best shape of crash barrier posts. Posts of this shape comprise a leg which is let into the ground and a shoulder which projects laterally from the upper end of the leg. The rail is attached to this shoulder and the shoulder serves to space the rail some distance from the leg. This is an important consideration as it substantially reduces the possibility of damage to the post when the rail is struck a glancing blow by a vehicle. It is impractical and would in any event uneconomic to fabricate a single piece post of this type from wood. Even if such a post were made it would be very prone to breaking at the junction of the shoulder and the leg both when the post is being driven into the ground and also in service. For this reason wooden posts of this type are made up of two pieces. This in turn makes the job of erecting the posts cumbersome and expensive.

It is an object of the invention to provide an economical one piece post for supporting a crash barrier rail or at least to offer the public a post of alternative design.

SUMMARY OF THE INVENTION

According to the invention there is provided a post for supporting a crash barrier rail, the post being a one piece moulding of plastics material and comprising a leg and at least one shoulder projecting transversely from the leg with an outer face having a shape which is complemental to the shape of an inner face of the rail so that the inner face of the rail and the outer face of the shoulder fit together to assist positioning the rail on the shoulder.

In one form of the invention the inner face of the rail comprises a longitudinally extending channel formation and the outer face of the shoulder comprises a protuberance which is received in the channel formation. Where the inner face of the rail comprises two longitudinally extending channel formations located one above the other the outer face of the shoulder advantageously comprises two protuberances which are received one in each of the channel formations.

In one aspect of the invention the post comprises fastening means for fastening the rail to the post, the fastening means being located between the two protuberances. In one form of the invention the fastening means comprises a nut which is moulded into the plastics material. Advantageously a passage for receiving a bolt is moulded into the plastics material, the passage extending from the outer face of the shoulder to the nut.

In one form of the invention the shoulder comprises a transverse passage. Advantageously, below the transverse passage the shoulder has a portion which is of diminished stiffness so that it will readily yield elastically when the rail is impacted.

The post is advantageously moulded from recycled plastics material.

BRIEF DESCRIPTION OF THE DRAWINGS

The invention is further discussed with reference to the accompanying drawings in which various examples of a crash barrier post are illustrated and in which:

FIG. 1 is a side view of a first post with a rail (shown in end view) ready to be mounted thereon;

FIG. 2 is a front view of the post shown in FIG. 1;

FIG. 3 is a perspective view of the post shown in FIGS. 1 and 2;

FIG. 4 is a view from below of a second post;

FIG. 5 is a view from below of a third post;

FIG. 6 is a view from below of a fourth post;

FIG. 7 is a side view, similar to FIG. 1, of the upper end of a fifth post; and FIG. 8 is a fragmentary view of part of a modified leg of a post.

DESCRIPTION OF ILLUSTRATED EMBODIMENTS

Referring first to FIGS. 1 to 3, the post is shown at 10 and the rail is shown at 12. The post is a one-piece plastics moulding. The post comprises a leg 14 of square cross section, about 125 mm ×125 mm. A shoulder 16 projects to one side of the leg at the upper end thereof. The shoulder has an outer face comprising two protuberances 18, 20 located one above the other. The protuberances are substantially similar to one another and are shaped complementally to the shape of the back face of the rail so that the upper protuberance 18 fits neatly into the upper channel 22 of the rail and the lower protuberance 20 fits neatly into the lower channel 24.

A steel nut, shown in dotted outline at 26, is moulded into the post between the protuberances 18, 20. The nut may comprises a block of steel or other metal with a passage drilled and threaded therein; or a commercially available hexagonal nut with wings welded thereon to prevent it from turning; or any other suitable device having a threaded passage formed therein. A passage 28 is also mounted into the post. The passage extends from the outer face of the shoulder to the nut and provides access to the nut for a bolt 30 which is used to fix the rail on the post.

The overall length of the post shown in FIGS. 1 to 3 is 1.8 meters. It is 125 mm wide and the overall horizontal length of the shoulder is 450 mm. Other dimensions can be derived from the Figures which are drawn substantially to scale.

It is a substantial advantage of the posts constructed according to the invention that only two men are required to erect the rails thereon. Each rail is lifted by the men (one at each end) and offered up to the posts. The protuberances serve to locate the rail in its correct vertical position. The protuberances also provide some support for the rail so that the same two men can move the rail horizontally to bring the bolt holes in the rail into alignment with the passages 28 and screw the bolts into the nuts 26 to secure the rail.

Another advantage of the one-piece plastics post is that the upper face thereof has a greater surface area for driving the post into the ground. The plastics material is much more resilient than wood while at the same time being less, or at least no more, likely than wood to cause bodily injury to persons or physical damage to vehicles in the event of an accident. The plastics material can be provided with an inhibitor such as carbon black to prevent deterioration under the action of ultraviolet light. The post is rot proof and likely to be much longer lasting than wood.

The post can be fabricated from recycled plastics materials and is therefore very economical. Waste plastic, which generally occurs in a mixture of plastic types—different articles, and different components of articles often being made of different plastics—is ground or otherwise reduced to small granules which are then fed into an extruder. They are drawn or pushed along a channel in which they are heated. Different plastics have greatly different melting points—at the temperatures at which a PVC plastic will melt, other plastics such as polyethylene will burn up and become gritty carbonized masses. Conversely, at a temperature at which polyethylene melts, PVC may remain solid. Most plastic used commercially and made available as recyclable waste is polyethylene but enough PVC and other plastic is generally mixed so that conventional extrusion and injection moulders become blocked and clogged by unmelted masses in the mixture.

The elements of the apparatus will preferably heat the mixture to a temperature where at least 30% of the mixture is molten. This temperature and percentage will of course vary, depending on the type of plastic used, but the exact proportion of unmolten to molten plastic in the mass is not critical, and 100% of the plastic might be molten in a particularly pure batch of one type of plastic. The most preferred materials for the molten or bonding phase of the mixture consists of polyethylene (of high or low density) or polypropylene. It has been found that granules of other plastics or other materials can be embedded in the bonding phase to form a tough useful product. Other materials, such as wood, paper, metal or paint might easily also be included in amongst the waste plastic, and either burn up or remain solid, but as long as the foreign bodies remnant in the final product are not significantly larger than the plastic granules, and the requisite proportion of molten plastic is present, this will not substantially lessen the usefulness of the final mixture.

Low density polyethylene would also be suitable for the post, 100% low density polyethylene may be used provided it is of the right grade such as film grade or pipe grade. Injection moulding grade would usually not be suitable as its impact resistance is low. Usually it would be beneficial to add about 20% high density polyethylene to the low density grade.

In one example, a typical mix of plastics is 70% low density polyethylene, 20% high density polyethylene and the balance polypropylene, all of these materials being from recycled stocks.

After being heated and to some degree molten, the mixture is transferred by a wide-bore screw extruder to a mould. The mould is in the form of a cavity, with the base shaped with various protrusions and/or movable pins to create the hollows and projections in the surface of the final product.

A quantity of the plastic mix is injected into the mould by the screw extruder, and a cover is then ram-pressed onto it to squeeze the plastic into every part of the mould.

The plastic mix cools and sets in the mould, and may then be removed.

The resulting product is preferably a slightly flexible, light, non-corroding, non-absorbent and strong post. It will not in normal use chip or crack, but may be sawn or drilled.

Clearly the shape and number of the formations which locate and support the rail can be varied within wide limits as long as they serve their primary function. Indeed the formations need not be protuberances at all. For example, a single recess may be provided which receives the projecting portion of the rail located between the two channels. Alternatively, one or other of the protuberances 18, 20 may be omitted if this is considered necessary or a single large protuberance could be provided to fit into a rail comprising a single channel.

The post 10*a* shown in FIG. 4 has two shoulders 16*a* located on opposite sides of the leg 14*a*. The shoulders 16*a* may each be substantially identical to the shoulder 16 and the leg 14*a* may be substantially identical to the leg 14. Similarly the posts 10*b* and 10*c* shown in FIGS. 5 and 6 have three shoulders 16*b* and four shoulders 16*c* respectively on single legs 14*b*, 14*c*. The posts with multiple shoulders are useful for positioning at street corners and other locations where rails meet.

It may be useful to allow an extra degree of resilience in the rail. To this end the shoulder may be designed to yield more readily when the rail is hit. One way to achieve this is to provide a transverse passage 40 in the centre of the shoulder as shown in FIG. 7. Alternatively, or in addition, a curved recess 42 may be provided in the lower face of the shoulder. Where both the passage 40 and the recess 42 are provided the ligament 44 between the two, due to its diminished cross section and consequent stiffness, will readily deform elastically when the rail is impacted.

An added advantage of the transverse passage 40 is that the nut 26 can be located therein. The nut does not therefore have to be moulded into the post.

In yet another example the outer face of the shoulder may comprise a recess for receiving the rail. This is particularly useful in the case of a rail of half-round cross section.

The leg of each post illustrated in the drawings may be designed to shear off at a predetermined location and/or when a predetermined force is applied thereto. One manner of achieving this is shown in FIG. 8. A recess 50 is provided which extends around the periphery of the leg and is located at a predetermined distance from the end of the leg. The leg will fail at the recess when the post undergoes impact and the force required to cause the leg to fail can be regulated by altering the depth of the recess. The recess can be formed in the leg when the post is moulded.

The lower end of the leg can be chamfered as shown at 52 in FIG. 1 to assist penetration when the post is driven into the ground. Again, the chamfered end can be formed when the post is moulded.

I claim:

1. A post for supporting a crash barrier rail, the post being a one piece moulding of plastics material and comprising a leg and at least one shoulder projecting transversely from the leg with an outer face having a shape which is complemental to the shape of an inner face of the rail so that the inner face of the rail and the outer face of the shoulder fit together to assist positioning the rail on the shoulder.

2. A post according to claim 1, in which the inner face of the rail comprises a longitudinally extending channel formation and the outer face of the shoulder comprises a protuberance which is received in the channel formation.

3. A post according to claim 1, in which the inner face of the rail comprises two longitudinally extending channel formations located above the other and the outer face of the shoulder comprises two protuberances which are received one in each of the channel formations.

4. A post according to claim 3, comprising fastening means for fastening the rail to the post, the fastening means being located between the two protuberances.

5. A post according to claim 3, comprising a nut for fastening the rail to the post, the nut being moulded into the plastics material.

6. A post according to claim 5, in which a passage is moulded into the plastics material, the passage extending from the outer face of the shoulder to the nut.

7. A post according to claim 1, in which the shoulder comprises a transverse passage.

8. A post according to claim 7, in which below the transverse passage the shoulder has a portion which is of diminished stiffness so that it will readily yield elastically when the rail is impacted.

* * * * *